US005515821A

United States Patent [19]

Wolck, Jr.

[11] Patent Number: 5,515,821

[45] Date of Patent: May 14, 1996

[54] VALVE SPRING RETAINER STEM OIL SHIELD

[75] Inventor: John G. Wolck, Jr., Mercer, Pa.

[73] Assignee: General Electric Company, Erie, Pa.

[21] Appl. No.: 344,784

[22] Filed: Nov. 22, 1994

[51] Int. Cl.[6] ..... F01M 9/10; F16K 41/00

[52] U.S. Cl. ..... 123/90.37; 123/188.6; 123/188.9; 251/337

[58] Field of Search ..... 123/90.33, 90.37, 123/90.67, 188.9, 188.13, 188.6; 251/337

[56] References Cited

U.S. PATENT DOCUMENTS

| | | | |
|---|---|---|---|
| 2,732,836 | 1/1956 | Phillips | 123/90.37 |
| 2,759,466 | 8/1956 | Heimbuch | 123/90.37 |
| 2,844,134 | 7/1958 | Sietman | 123/90.67 |
| 2,855,915 | 10/1958 | Norton | 123/90.37 |
| 3,043,284 | 7/1962 | Gundstorm | 123/90.67 |

FOREIGN PATENT DOCUMENTS

| | | | |
|---|---|---|---|
| 534449 | 5/1955 | Italy | 251/337 |

*Primary Examiner*—Weilun Lo
*Attorney, Agent, or Firm*—Marvin Snyder

[57] ABSTRACT

A method and apparatus for inhibiting leakage of lubricating oil into an intake manifold and cylinder of a diesel engine during idling incorporates a seal press fit onto one end of an intake valve stem adjacent a tappet assembly coupled in driving relationship with the valve. In an illustrative form the seal comprises an annular ring sized to the valve stem and having a flexible, circumferential flange adapted for sealing engagement with a valve spring retainer attached to the valve. The flange of the seal engages an inner annular, chamfered surface on the valve spring retainer, the chamfered surface being located adjacent the one end of the valve stem.

6 Claims, 3 Drawing Sheets

VALVE SPRING RETAINER STEM OIL SHIELD

BACKGROUND OF THE INVENTION

The present invention relates to internal combustion engines and, more particularly, to an improved method and apparatus for preventing oil leakage into a cylinder of an engine by oil flow along a stem of an engine valve.

Internal combustion engines and, in particular, diesel engines of the type used in diesel-electric propulsion systems, utilize overhead valve systems in which lubricating oil is pumped to a location above the valves from whence it flows by gravity back to an oil sump. The oil is pumped through hollow valve push rods to rocker arms which are connected in driving relationship to valve tappet assemblies that operate the valves. The valve tappet assemblies include means for carrying oil from the rocker arms to their interfaces with the valves. The valve tappet assembly includes a tappet foot seated on an end of the valve stem, which foot includes a bottom aperture that allows oil to pass through and lubricate the contact surface between the tappet foot and valve stem end. The tappet foot upper surface is cup-shaped for receiving a tappet ball end of a tappet shank and allows excess oil to overflow and spill onto the area at the end of the valve.

During low speed operation of the engine, particularly when the engine is allowed to idle, pressure in the cylinder drops to a low value, tending to draw oil into the cylinder along the valve stem through the valve guide. Such oil accumulates in the cylinder and the intake manifold in a partially burned condition. When the engine is subsequently brought up to a running speed, the unburned combustion products, a mixture of oil and soot, is discharged from the engine and sprayed into the air where it rapidly precipitates out onto the locomotive and surrounding surfaces. Incomplete combustion of this oil material also results in undesirable smoking of the engine.

Heretofore it has been the practice to attempt to prevent oil from leaking into diesel engine cylinders through engine valves by installing an umbrella-like device about the valve stem between the valve spring retainer and the valve guide. This device fits snugly about the valve stem and prevents oil from running down the valve stem into the valve guide. The device is shaped as an annular ring having a sloped or chamfered outer circumferential perimeter. In essence, the oil is diverted outward from the valve stem over the outer perimeter of the device and away from the valve stem. While this device is generally effective, it has the disadvantage of being difficult to access for either installation or repair since it is located below a valve keeper and within a valve spring. Accordingly, it would be desirable to provide a method and apparatus for deflecting oil from the valve stem but without the servicing difficulties of the prior art.

SUMMARY OF THE INVENTION

One object of the present invention is to provide an improved method and apparatus for preventing oil leakage about a diesel engine valve stem.

Another object of the invention is to provide a method and apparatus for preventing oil leakage about a diesel engine valve stem which avoids the installation and repair disadvantages of the prior art.

Briefly, in accordance with one form of the present invention, a valve assembly for an overhead valve diesel engine includes a valve having a valve stem and a valve spring surrounding the valve stem. A valve spring retainer is positioned on the valve stem and fastened to the stem by means of a valve keeper. The valve spring engages the valve spring retainer for urging the valve in a closing direction. An oil seal is sealingly engaged with the valve stem at an end thereof adjacent the valve spring retainer. The oil seal is positioned on the distal end of the valve stem on the side of the valve spring retainer opposite the valve spring. The oil seal generally comprises an annular member in press fit engagement with the valve stem and has a flexible flange circumscribing the annular portion which engages a chamfered surface on the upper side of the valve spring retainer.

During operation of the engine, the valve is actuated by a rocker arm through a valve tappet assembly which presses on the end of the valve stem. Oil flows through a center aperture in the tappet assembly and lubricates the contact surface between the valve tappet assembly and the valve stem. Oil which would normally flow along the valve stem towards an engine cylinder is diverted by the oil seal surrounding the top end of the valve stem and flows outward over the edges of the valve spring retainer rather than along the valve stem.

BRIEF DESCRIPTION OF THE DRAWINGS

The features of the invention believed to be novel are set forth in the appended claims. The invention, however, together with further objects and advantages thereof, may best be understood by reference to the following description taken in conjunction with the accompanying drawings in which:

DETAILED DESCRIPTION OF THE INVENTION

Figure 1:
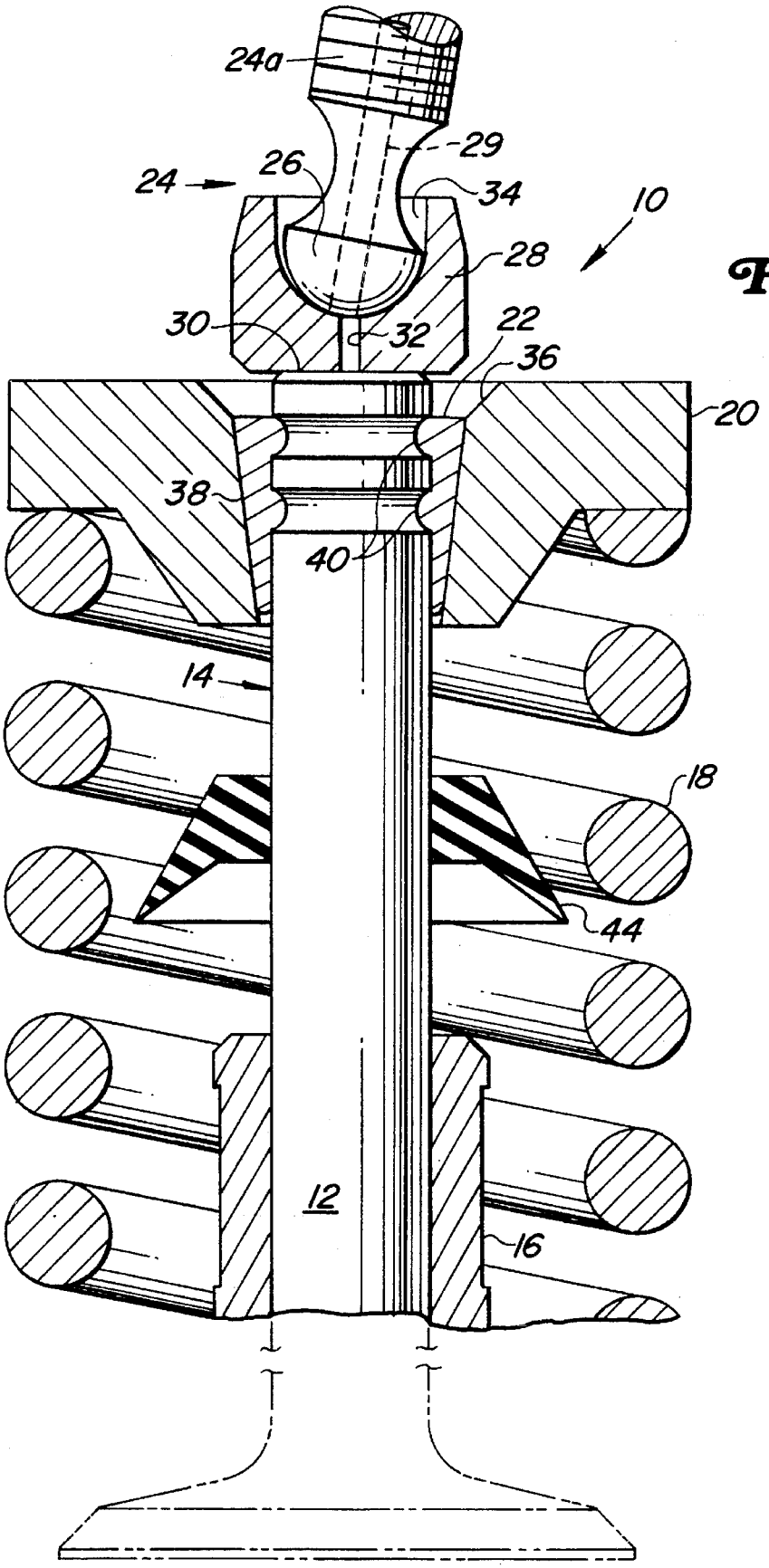
FIG. 1 is a simplified cross-sectional view of fuel intake valve stem assembly in accordance with the prior art.

In FIG. 1, which is a simplified cross-sectional view of a prior art valve stem assembly for an overhead valve diesel engine, a valve assembly 10 is shown to include a valve 12 having a valve stem 14. The valve operates within a valve guide 16 which allows the valve to move axially within the valve guide and open and close an opening into a cylinder of the diesel engine. The valve is held in a normally closed position by means of a valve spring 18. Valve spring 18 reacts at one end against a spring support (not shown) attached to the engine block (not shown) and at an opposite end against a valve spring retainer 20. Valve spring retainer 20 is fastened or held at the end of valve stem 14 by a valve keeper 22. As is well known, the valve is moved to an open position by operation of a tappet assembly 24 coupled to a rocker arm (not shown) which is driven by a push rod (not shown) which, in turn, is driven from an engine cam shaft (not shown). Tappet assembly 24 includes a threaded shank 24A terminating in a hemispherical end or tappet ball 26 which rests within a mating socket in a valve tappet boot 28. Valve tappet boot 28 provides the interface between tappet assembly 24 and valve stem 14.

Tappet assembly 24 is operative to push valve 12 in a downward direction as shown in FIG. 1 to open the valve into an engine cylinder. Valve 12 is closed or returned to its normal closed state by valve spring 18. To minimize wear at the interface between the valve stem and valve tappet assembly, lubrication is provided to the contact surfaces 30 between valve tappet boot 28 and valve stem 14. This lubrication is in the form of oil pumped through the push rod to the top of the engine and distributed down through a central hole 29 in tappet shank 24A and tappet ball 26 into a cavity 34 in valve tappet boot 28. A small hole 32 allows oil in valve tappet cavity 34 to flow to the top of the valve stem at surfaces 30 and provide a lubricated interface contact between valve tappet boot 28 and valve stem 14. The volume of oil flow through tappet shank 24A is greater than the volume of oil flow through aperture 32 so that the residual oil accumulates in concave cavity 34. The volume of oil in cavity 34 eventually exceeds the cavity capacity, at which time the residual oil overflows the sides of valve tappet boot 28 and runs down along the sides of boot 28 and on to the top surface of valve spring retainer 20. The upper surface of the retainer is provided with an inner chamfered surface 36 at an upper surface of a central aperture 38 within which valve stem 14 and valve keeper 22 are positioned.

Figure 2:
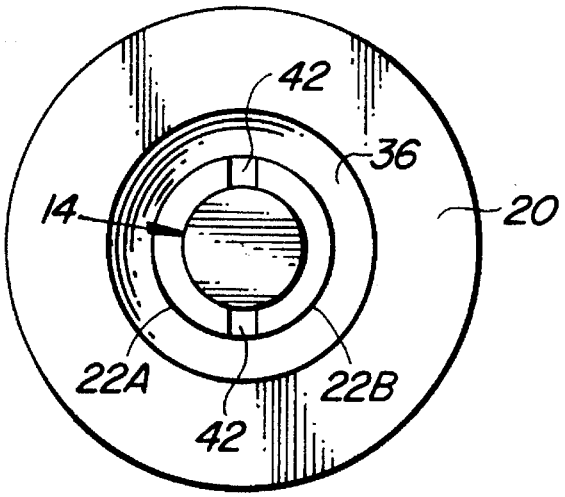
FIG. 2 is a top view of a valve stem and valve spring retainer assembly showing the oil leakage path along the valve stem.

FIG. 2 is a top view of valve stem 14 and valve spring retainer 20 with the valve tappet boot omitted. Valve keeper 22 is seen to comprise two separate parts 22A and 22B which fit around valve stem 14. Valve keeper parts 22A and 22B have inner grooved surfaces which mate with grooved surfaces 40 (FIG. 1) adjacent the end of valve stem 14.

In order to assemble valve assembly 10, as shown in FIG. 1, valve spring 18 and valve spring retainer 20 are placed around valve stem 14 and then pressed downward until grooves 40 are exposed. The valve spring retainer is held in this depressed position while valve keepers 22 are placed around the valve stem engaging grooves 40. The retainer is then allowed to move upward under pressure from spring 18 trapping the tapered cut valve keepers 22 in tapered aperture 38 of the valve spring retainer. A gap 42 between the edges of the two valve keeper segments 22A and 22B constitutes a path through the valve keeper and valve spring retainer for oil entering the upper portion of cavity 38 adjacent chamfered areas 36. This oil drains downward along valve stem 14 until it reaches valve guide 16. If the engine is running at a low speed or is idling, pressure within the cylinder drops to a low level which may be less than the valve stem assembly ambient pressure. Consequently, oil tends to flow along the valve stem within valve guide 16 so as to enter the intake manifold and engine cylinder through the valve guide. As previously mentioned, this accumulation of oil within the intake manifold and cylinder results in undesirable emissions when the cylinder is again operated at normal power.

In order to prevent this intake of oil by the cylinders, it is conventional practice to attach an umbrella 44 to valve stem 14 between valve spring retainer 20 and valve guide 16. Umbrella 44 intercepts the downward flowing oil along valve stem 14 and diverts the oil radially outward over the edges of umbrella 44. Most of the oil thus diverted away from valve stem 14 is accordingly diverted away from the interface between valve stem 14 and valve guide 16 and therefore very little oil is drawn into the cylinder through valve guide 16. While this arrangement minimizes engine emissions caused by oil drawn into the engine along valve stem 14, use of umbrella 44 introduces a servicing problem since the umbrella is not readily accessible without disassembling the valve assembly. More particularly, in order to replace umbrella 44, it is necessary to disassemble the valve assembly, which requires removal of the valve spring retainer, valve keeper, and tappet assembly.

Figure 3:
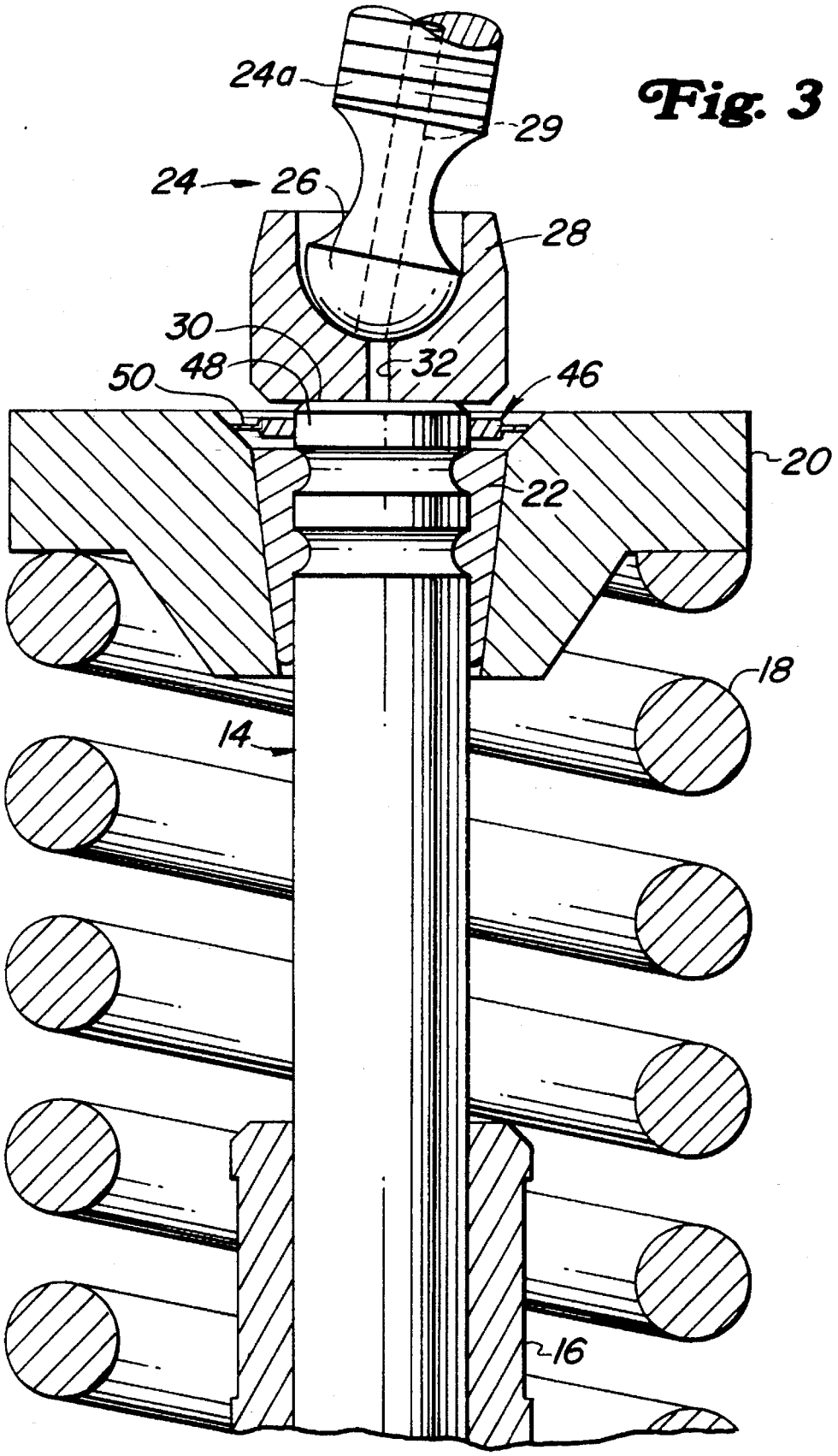
FIG. 3 is a view corresponding to FIG. 1 showing utilization of the improved oil seal of the present invention.

FIG. 3 illustrates a valve assembly corresponding to the valve assembly of FIG. 1, but incorporating an oil seal arrangement in accordance with the present invention. The basic structure of the valve assembly remains unchanged except that umbrella 44 is no longer required. In the present invention, an oil seal 46 is positioned at the end of valve stem 14 adjacent contact surfaces 30. Seal 46 is of annular shape, having a central aperture 49 which is fitted snugly about the upper land 48 on valve stem 14 such as by being press fitted onto the valve stem. Seal 46 further includes an outer circumferential flange 50 which is flexible and so designed that when the seal is pressed downward onto land 48, flange 50 engages chamfered inner surface 36 of valve spring retainer 20. Seal 46 can be pressed downward so that a slight deflection of flange 50 occurs to provide a tight seal between the flange 50 and the valve spring retainer. In this manner, seal 46 prevents oil from leaking downward around valve stem 14 by completely sealing the valve stem against oil leakage around the inside of seal 46 and around the outside flange edges 50. Thus oil cannot leak through the gap between valve keepers 22A and 22B (FIG. 2).

Figure 4A:
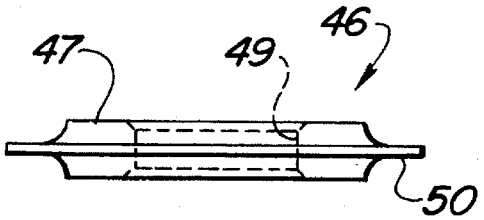
FIGS. 4A and 4B are edge and plan views of one form of oil seal which may be used with the present invention.
Figure 4B:
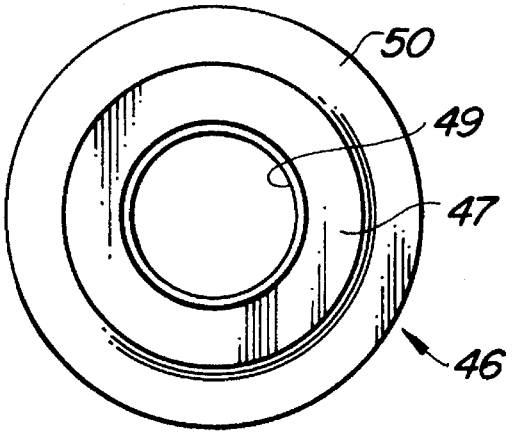

FIGS. 4A and 4B illustrate oil seal 46 in a form which comprises an inner annular region 47 having a central aperture 49 of inner diameter sized to fit snugly about valve stem 14 (FIG. 3) and an outer flexible flange 50 sized to engage chamfered areas 36 on valve spring retainer 20, as shown in FIG. 3. By way of example and not of limitation, annular region 47 of seal 46 may have a thickness approximately 0.14 inches and flange 50 may have a thickness of approximately 0.02 inches. The diameter of seal 46 may be varied depending upon the sizes of valve spring retainer 20 and valve stem 14. Since oil seal 46 does not provide any structural support, it can be made of any one of various types of oil resistant material, such as Viton fluoroelastomer sold by E. I. DuPont de Nemours and Co., Wilmington, Del., resulting in a lower cost than prior designs using umbrella 44.

While only certain preferred features of the invention have been illustrated and described, many modifications and changes will occur to those skilled in the art. It is, therefore, to be understood that the appended claims are intended to cover all such modifications and changes as fall within the true spirit of the invention.

What is claimed is:

1. A valve assembly for an overhead valve diesel engine, said assembly comprising:

a valve, including a valve stem;

a valve spring;

a valve spring retainer positioned on said valve stem at one end thereof and fastened thereto by a valve keeper, said valve spring engaging said valve spring retainer for urging said valve in a closing direction; and an oil seal situated wholly within a recess in said valve spring retainer and self-sealingly engaged with said valve stem and said valve spring retainer for inhibiting oil flow past said valve spring retainer along said valve stem, said seal being of substantially planar configuration before and after installation on said valve assembly and including a flexible, outer circumferential flange in contact with said valve spring retainer, said flange being substantially thinner than an inner annular region of said seal.

2. The valve assembly of claim 1 and including a valve tappet boot for engaging said end of said valve stem, and a tappet shank for carrying oil into said valve tappet boot, said oil seal being spaced apart from said valve tappet boot.

3. The valve assembly of claim 1 wherein said oil seal comprises an annular ring sized to be frictionally retained on said valve stem and having a flexible circumferential flange for sealingly engaging said valve spring retainer.

4. The valve assembly of claim 3 wherein said valve spring retainer is formed with a chamfered inner opening for engaging said flange of said oil seal.

5. A method for preventing oil leakage into a cylinder of an internal combustion engine from oil flow along a stem of an engine valve, the oil flow arising from oil flow through a tappet assembly situated in driving relationship with an end of the valve and flowing through a valve spring retainer and valve keeper coupled to the end of the valve, the method comprising the steps of:

positioning a seal on the end of the valve stem, said seal being of substantially planar configuration before and after installation on the valve stem and including a flexible, outer circumferential flange which is substantially thinner than an inner annular region of the seal: and pressing the seal into sealing engagement with the valve stem and such that said circumferential flange makes sealing contact with said valve spring retainer and said seal becomes wholly positioned within a recess in the valve spring retainer so as to divert oil at the end of the valve stem to an outer perimeter of the valve spring retainer away from the valve stem.

6. The method of claim 5 wherein the step of positioning includes the step of establishing a press fit between the valve stem and the seal.

* * * * *